US005137034A

United States Patent [19]

Perfetti et al.

[11] Patent Number: 5,137,034

[45] Date of Patent: Aug. 11, 1992

[54] SMOKING ARTICLE WITH IMPROVED MEANS FOR DELIVERING FLAVORANTS

[75] Inventors: Thomas A. Perfetti, Winston-Salem; Gary W. Worrell, Tobaccoville, both of N.C.

[73] Assignee: R. J. Reynolds Tobacco Company, Winston-Salem, N.C.

[21] Appl. No.: 408,433

[22] Filed: Sep. 15, 1989

Related U.S. Application Data

[63] Continuation of Ser. No. 194,696, May 11, 1988, abandoned.

[51] Int. Cl.[5] ..... A24D 1/00; A24D 1/02

[52] U.S. Cl. ..... 131/194; 131/335

[58] Field of Search ..... 131/335, 194, 195

[56] References Cited

U.S. PATENT DOCUMENTS

| | | |
|---|---|---|
| 2,063,014 | 1/1928 | Allen . |
| 3,236,244 | 3/1966 | Irby et al. . |
| 3,344,796 | 11/1967 | Yamaji et al. . |
| 3,426,011 | 3/1969 | Parmerter et al. . |
| 3,540,456 | 6/1971 | McGlumphy et al. . |
| 3,550,598 | 8/1971 | McGlumphy et al. . |
| 3,744,496 | 12/1973 | McCarty et al. . |
| 3,902,504 | 2/1976 | Owens et al. . |
| 3,972,335 | 5/1976 | Tigglebeck et al. . |
| 4,079,742 | 3/1978 | Rainer et al. . |
| 4,225,636 | 10/1980 | Cline et al. . |
| 4,505,282 | 12/1985 | Cogbill et al. . |
| 4,714,082 | 12/1987 | Banerjee et al. . |

FOREIGN PATENT DOCUMENTS

| | | |
|---|---|---|
| 203599 | 3/1955 | Australia . |
| 56131 | 3/1965 | Australia . |
| 291819 | 3/1965 | Australia . |
| 0174645 | 6/1985 | European Pat. Off. . |
| 0212234 | 3/1987 | European Pat. Off. . |
| 0254848 | 2/1988 | European Pat. Off. . |
| 2163008 | 6/1973 | France . |
| 8201585 | 11/1982 | Netherlands . |
| 475418 | 6/1959 | Switzerland . |
| 951510 | 11/1952 | United Kingdom . |
| 759341 | 6/1956 | United Kingdom . |

OTHER PUBLICATIONS

Brozinski, M. et al., Beitrage zur Tabakforschug International 6, 124–130 (1972).

Curran, J. G., Tobacco Science 16, 40–42 (1972).

Reihl, T. F. et al., Tobacco Science 17, 10–11 (1973).

Lange's Handbook of Chemistry 10, 272–274 (11th ed., 1973).

Leffingwell et al., Tobacco Flavorings for Smoking Products R.J. Reynolds Tobacco Company, Winston-Salem, N.C. (1972).

Ames et al., Mut. Res., 31:347–364 (1975).

Nagao et al., Mut. Res., 42:335 (1977).

Albert Eble; The Effects of Migration and Elution on Menthol Delivery in Cigarettes; R.J. Reynolds Tobacco Co. Winston-Salem, N.C. U.S.A. pp. 261–280 (1987).

D.E. Mathis; Migration and Delivery of Filter Flavors; Beitrage zur Tabakforschung International vol. 12 No. 1 Feb. (1983).

Hachk's Chemical Dictionary 672. (4th ed., 1969).

*Primary Examiner*—V. Millin

*Attorney, Agent, or Firm*—Grover M. Myers; David G. Conlin

[57] ABSTRACT

The present invention generally relates to a smoking article having a fuel element, a physically separate aerosol generating means, a mouthend piece, and improved means for delivering one or more flavorants to the user which comprises a carbon filled sheet material longitudinally disposed behind the aerosol generating means in a non-burning portion of the smoking article which carries or otherwise contains one or more flavorants. More specifically, the present invention is directed to a carbon filled sheet of tobacco employed as at least as a portion of the mouthend piece of such articles to carry flavorants, particularly highly volatile flavorants like menthol.

41 Claims, 2 Drawing Sheets

MG MENTHOL / FUEL

| PROTO-TYPE | INITIAL % MENTHOL LOAD | HIGH | LOW | MEAN | % TRANSFER TO FUEL SOURCE |
|---|---|---|---|---|---|
| A | 3.9 | 0.58 | 0.47 | 0.54 | 14 |
| B | 3.9 | 0.52 | 0.50 | 0.51 | 13 |
| C | 1.5 | 0.20 | 0.17 | 0.18 | 12 |
| D | 2.0 | 0.19 | 0.16 | 0.17 | 8.5 |
| E | ND | 0.17 | 0.12 | 0.14 | ND |
| F | 2.2 | 0.09 | 0.07 | 0.09 | 2.2 |
| G | 4.0 | 0.006 | 0.005 | 0.005 | 0.1 |

SMOKING ARTICLE WITH IMPROVED MEANS FOR DELIVERING FLAVORANTS

This is a continuation of copending application Ser. No. 07/94,696 filed on May 11, 1988, now abandoned.

BACKGROUND OF THE INVENTION

The present invention relates to smoking articles generally having a fuel element, a physically separate aerosol generating means, and a separate mouthend piece, and having improved means for delivering one or more volatile flavorants to the user which comprises a carbon filled sheet material located in a non-burning portion of the smoking article which bears or otherwise carries or contains one or more flavorants. As used herein, the term "smoking article" includes cigarettes, cigars, pipes, and other smoking products which generate an aerosol such as smoke. More specifically, the present invention is preferably directed to a carbon filled sheet, preferably containing tobacco, the sheet being employed as at least a portion of the mouthend piece of such articles to carry flavorants, particularly highly volatile flavorants like menthol.

Cigarettes, cigars and pipes are the most popular forms of smoking articles. Many smoking products and smoking articles have been proposed through the years as improvements upon, or as alternatives to, these popular forms of smoking articles, particularly cigarettes.

Many, for example, have proposed tobacco substitute smoking materials. See, e.g., U.S. Pat. No. 4,079,742 to Rainer et al. Two such materials, Cytrel and NSM, were introduced in Europe in the 1970's as partial tobacco replacements, but did not realize any long-term commercial success.

Many others have proposed smoking articles, especially cigarette smoking articles, based on the generation of an aerosol or a vapor. See, for example, the background art cited in U.S. Pat. No. 4,714,082 to Banerjee et al.

As far as the present inventors are aware, none of the foregoing smoking articles has ever realized any significant commercial success and none have ever been widely marketed. The absence of such smoking articles from the marketplace is believed to be due to a variety of reasons, including insufficient aerosol generation, both initially and over the life of the product, poor taste, off-taste due to thermal degradation of the smoke former and/or flavor agents, the presence of substantial pyrolysis products and sidestream smoke, and unsightly appearance.

Thus, despite decades of interest and effort, there is still no smoking article on the market which provides the benefits, advantages and pleasures associated with smoking, without delivering considerable quantities of incomplete combustion and pyrolysis products.

Recently, however, in European Patent Publication Nos. 0174645 and 0212234 and U.S. Pat. No. 4,714,082, assigned to R.J. Reynolds Tobacco Co., there are described smoking articles, especially cigarette smoking articles, which are capable of providing the benefits, advantages and pleasures associated with smoking, without burning tobacco or delivering appreciable quantities of incomplete combustion or pyrolysis products. The improved flavorant delivery means of the present invention are particularly suited for use with such articles.

Mentholated smoking articles represent a substantial portion of the total market. In fact, nearly one-third of all cigarettes produced are mentholated to some extent. However, one of the major problems with menthol and other volatile and semi-volatile flavorants applied to smoking articles is that the flavorants usually migrate to other components of the article. Such migration is well documented in the literature. See, e.g., Brozinski, M. et al., Beitrage zur Tabakforschug International 6, 124–130 (1972); Curran, J.G., Tobacco Science 16, 40–42 (1972); and Reihl, T.F. et al., Tobacco Science 17, 10–11 (1973).

In cigarettes, migration occurs whether the flavorants are incorporated into the tobacco, the filter, the wrapping materials, or on the packaging materials (e.g., mentholated foil). The end result for all such applications is similar. During storage, an equilibrium level of flavorant results, with the flavoring material migrating through the entire smoking article and associated packaging. The degree of migration depends on, among other things, the flavorant's vapor pressure, its solubility in the various components of the article, environmental conditions including temperature and relative humidity, the resistance to migration of the various materials (e.g., tobacco, wrapper, filter material, glue, etc.).

A number of attempts to solve migration-related problems have been made, but have met with limited success. For example, various chemicals have been employed such as chemically bonded non-volatile substances in order to reduce migration (e.g., beta-cyclodextrin menthol complexes, glucosides of menthol, menthol amides, esters, etc.). See, e.g., U.S. Pat. Nos. 3,426,011 to Parmerter et al. and 3,344,796 to Yamaji et al. In general, all of these compounds have limited application because of cost and because of the poor taste perceptions of the smoke delivered.

Others have studied the use of so-called microencapsulated flavorants in various locations in the smoking article. See, e.g., U.S. Pat. Nos. 3,550,598 and 3,540,456 to McGlumphy et al., Swiss Patent No. 475,418 to Baumgartner Papiers S.A. and Netherland Patent No. 8201585 to Dowve Egberts Koninklijke.

Still others have entrapped volatile flavorants into polymer systems such as linear low density polyethylene and inorganic filters e.g., $CaCo_3$, aluminas, etc., and placed these materials in the form of pellets or strands or particles in the filter systems or packaging systems. The problems with this approach are that migration still occurs (albeit, in a controlled manner), the loads of flavorants required with such materials are often very high and cost prohibitive, and the overall delivery rates of flavorants are low, usually between 1–18% by weight based on applied levels.

The use of carbon in various components of cigarettes has also been proposed. Specifically, carbon has been employed in wrapper systems, as filler material, and in filter systems for the reduction of gas phase smoke constituents, as well as for the introduction of flavorants to the cigarette. See, e.g , U.S. Pat. Nos. 2,063,014 to Allen, 3,744,496 to McCarty et al., 3,902,504 to Owens et al., 4,505,202 to Cogbill et al., and 4,225,636 to Cline et al. However, carbon, and in particular activated carbon has not found significant commercial use as a carrier of flavorants such as menthol since, among other reasons, activated carbon adsorbs the greater part of menthol before it can be delivered to the smoker. In order to compensate for this phenomenon, the carbon material is generally saturated with flavorant. However, as noted above, this results in undesirable migration of the flavorant to other components of the smoking article. See, for example, U.S. Pat. No. 3,236,244 to Irby et al. which describes the use of activated carbon both to remove undesirable constituents from smoke as well as to introduce flavoring agents thereto.

U.S. Pat. No. 3,972,335 to Tigglebeck et al. acknowledged this problem. Tigglebeck discloses blocking the small pores of activated carbon with a pore-modifying agent such as sucrose. The pore-modifying agent is disclosed as being used in amounts such that the less retentive portions of the activated carbon are not blocked but remain available for adsorption of the flavorant. Purportedly, this increases the shelf life of the smoking article by reducing migration of the flavorant while allowing efficient release of the flavorant during smoking. However, there appears to be substantial migration in excess of about 40%. See Example I at columns 5–6. As a result, carbon filters or carbon wrappers have not generally been recommended for mentholated smoking articles.

SUMMARY OF THE INVENTION

The present invention generally relates to a smoking article having a fuel element, a physically separate aerosol generating means, a separate mouthend piece and an improved means for delivering menthol and other volatile flavorants along with the aerosol, without any appreciable migration of the flavorant to the fuel element or other components of the smoking article. The improved flavorant delivery means comprises a carbon filled sheet material located in a non-burning portion of the smoking article, e.g., in any part of the article which is longitudinally disposed behind the fuel element and spaced from the fuel element. However, it is preferably in the form of a cylindrical segment or plug located between the aerosol generating means and the mouth end of the smoking article.

Preferably, the smoking articles which employ the improved flavorant delivery means are cigarettes, which utilize a short, i.e., less than about 30 mm long, preferably carbonaceous, fuel element. Preferably, the aerosol generating means is longitudinally disposed behind the fuel element and is in a conductive heat exchange relationship with the fuel element. The mouthend piece preferably comprises a filter segment, preferably one of relatively low efficiency, so as to avoid interfering with delivery of the aerosol produced by the aerosol generating means. The flavorant delivery means of the present invention comprises a carbon filled sheet material which may be used in any of the non-burning portions of the smoking article, i.e., in any of the components longitudinally disposed behind or otherwise in a spaced relationship with the fuel element. Preferably, it is located between the filter segment and the aerosol generating means. In certain preferred embodiments, the flavorant delivery means comprises a segment of rolled, folded or gathered carbon filled sheet of tobacco paper approximately 5–15 mm in length.

It has been found that the improved flavorant delivery means of the present invention helps to reduce migration of flavorants, especially menthol and other volatile flavorants, to other components of the smoking article or the equipment used to manufacture such articles. Reduction of migration to the fuel source is particularly important because of the undesirable off-taste which can result from thermal decomposition and pyrolysis of the flavorants present in the burning fuel element. This reduction in migration also helps increase the shelf life of smoking articles containing volatile flavorants, such as menthol. It has also been found that the flavorants are readily and uniformly released from the carbon filled sheet material during smoking as aerosol and hot gases from the aerosol generating means pass over or through the sheet material. It is believed that somewhat higher than normal aerosol temperatures, approximately 150° C. or so immediately behind the aerosol generating means, help in delivering uniform amounts of the flavorant over the life of the smoking article. Moreover, smoking articles employing the carbon filled sheet material as a component of the mouthend piece provide such reduced migration and uniform delivery of flavorants without substantial reduction in the delivery of other aerosol components, e.g., glycerin, water, and the like. In other words, the filter efficiency of the carbon filled sheet material is substantially lower than that of other cigarette filter materials such as cellulose acetate tow. This is important in maintaining the desired delivery of the aerosol produced by the smoking articles of the present invention.

The preferred carbon filled sheet material of the present invention also acts as a heat sink, which helps to reduce the temperature of aerosol perceived by the smoker and also helps to prevent undesirable degradation or melting of filter material.

Preferred smoking articles employing the improved flavorant delivery means in accordance with the present invention are capable of delivering at least 0.6 mg of aerosol, measured as wet total particulate matter (WTPM), in the first 3 puffs, when smoked under FTC smoking conditions, which consist of 35 ml puffs of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. The aerosol preferably also has no significant mutagenic activity as measured by the Ames Test. In addition, preferred articles may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like," generated by action of the heat from the burning fuel element upon substances contained within the aerosol generating means, or elsewhere in the article.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to transfer heat from the burning fuel to the aerosol generating means. Preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. Suitable insulators have a thermal conductivity in g-cal(sec) ($cm^2$) (°C/cm), of less than about 0.05, preferably less than about 0.02, most preferably less than about 0.005. See, *Hackh's Chemical Dictionary* 672 (4th ed., 1969) and Lange's *Handbook of Chemistry* 10, 272–274 (11th ed., 1973).

Smoking articles which employ the improved flavorant delivery means in accordance with the present invention are described in greater detail in the accompanying drawings and the detailed description of the invention which follow.

DETAILED DESCRIPTION OF THE PREFERRED EMBODIMENTS

Figure 1:
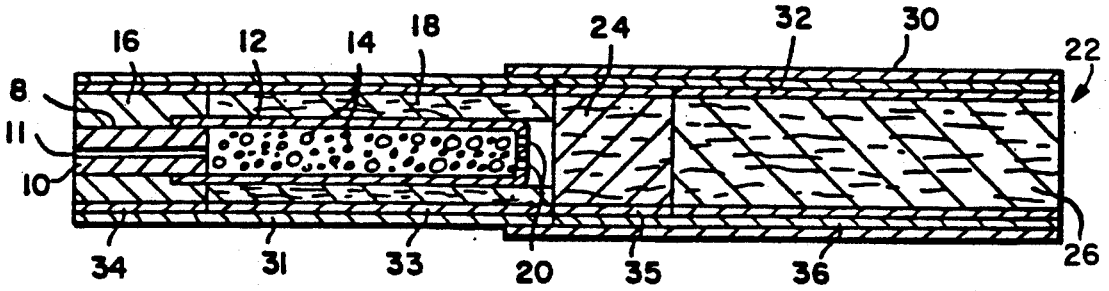
FIG. 1 is a longitudinal sectional view of one preferred cigarette employing the improved flavorant delivery means in accordance with the present invention.

In accordance with the present invention, there is provided an improved flavorant delivery means for use in smoking articles. The flavorant delivery means is particularly suited for smoking articles having a small combustible fuel element, a physically separate aerosol generating means, and a separate mouthend piece such as those described in the above-referenced EPO Publication Nos. 174,645 and 212,234.

In general, the improved flavorant delivery means comprises a carbon filled sheet material typically formed by adding carbon (activated, unactivated, or mixtures thereof) to ordinary paper pulp such as pulped wood or flax fibers and/or pulped tobacco stalks or stems. This material is then formed into a sheet material using conventional papermaking techniques.

While the porosity of the carbon filled sheet material may vary over a broad range, it preferably has an inherent porosity between about 100 and 250 CORESTA units, and a net porosity greater than about 150 CORESTA, preferably 300 and 30,000 CORESTA. Net porosity is achieved by providing holes by mechanical, electrostatic or laser means, and/or by slitting of the sheet material. Sheet materials having a porosity in this range are particularly advantageous since it allows greater amounts of flavorants to be loaded onto the carbon filled sheet material by adsorptive and/or absorptive mechanisms, and because the total surface area of the flavorant delivery means can be greatly increased without increasing the filtering efficiency of the carbon filled sheet material.

The carbon content of the sheet material may vary over a wide range depending on a number of factors including the type and amount of carbon and/or flavorant used, the location of the carbon filled sheet material in the smoking article, and the shape or configuration of the sheet material. In general, the carbon content may range between about 5 to 75 weight percent of the sheet material, preferably between about 10–40%, most preferably between about 15–30%. Although higher amounts of carbon may be used, sheets containing more than about 75% by weight carbon present paper manufacturing limitations as well as limitations in the characteristics of the paper, e.g., tensile strength, excess dusting, and related problems.

While either activated or unactivated carbon may be used as the carbon component of the sheet material, activated carbon is preferred. As will be appreciated by the skilled artisan, there are a multitude of activated carbons which are commercially available and which can be used in accordance with the teachings of the present invention. There are, for example, coal based, wood based and coconut hull based activated carbons available from a number of sources. One especially preferred activated carbon, a coconut hull based carbon, is PCB which is produced by Calgon Carbon Corporation, Pittsburgh, Pa. This particular carbon can be pulverized into a variety of sizes. Although nearly any size particles could be used in the sheet material in accordance with the present invention, preferred sizes range between about 250–600 U.S. mesh.

As the skilled artisan will appreciate, other adsorptive/absorptive materials may be incorporated into the sheet material in place of, or along with the carbon component of the sheet material. Such materials include charcoal, silica gel, zeolites, perlite, sepiolite, activated alumina, magnesium silicates, and the like.

As noted above, the carbon filled sheet material may be made using ordinary paper pulp. Preferably, it is made from a mixture of wood pulp and a pulp prepared from tobacco stalk or stems. The carbon component of the sheet material is generally added to a slurry of the pulp materials and the mixture thereof is formed into a sheet using conventional papermaking machinery. The preferred sheet material is a carbon filled tobacco paper prepared by incorporating the desired amount of carbon into the tobacco paper pulp used to manufacture a Kimberly-Clark tobacco paper designated P144-185-GAPF. Unmodified P144-185-GAPF includes about 60 percent tobacco principally in the form of flue-cured/-burley tobacco stems and 35 percent soft wood pulp (based on dry weight of the material). The moisture content of the unmodified sheet-like material preferably is between about 11 and 14 percent. The material has a dry tensile strength of about 1,600 to about 3,300 gm/inch, and a dry basis weight of about 38 to about 44 g/sq. meter. The material is manufactured using a conventional papermaking-type process including the addition of about 2 percent glycerin or other humectant, about 1.8 percent potassium carbonate, about 0.1 percent flavorants and about 1 percent of a commercial sizing agent. The sizing agent is commercially available as Aquapel 360XC Reactive Size from Hercules Corp., Wilmington, Del.

Flavorants may be incorporated into or onto the carbon filled sheet material in any of a number of ways such as spraying, dipping, printing, vapor deposition and the like. Preferably, the flavorant is applied to the sheet by a vapor deposition technique. Vapor deposition is a technique which typically comprises warming the flavorant to a point where it is highly volatile and passing or contacting the carbon filled sheet material with the vapors for a period sufficient to allow the desired quantity of flavorant to be absorbed/adsorbed onto the carbon filled sheet material. One preferred deposition technique, referred to as inner leaf transfer, comprises contacting the carbon filled sheet material with an inner leaf material. The inner leaf material may be any of a number of materials such as a heavy gauge plug wrap, provided that its affinity for the flavorant is less than that of the carbon filled sheet material of the present invention.

Another preferred method for applying flavorant to the sheet material comprises printing the flavorant onto the sheet material. In general, printing comprises passing the sheet material over a drum which rotates through a bath containing the flavorants of interest.

Still other methods of applying flavorants to the carbon either before or after it is incorporated into the sheet material will be readily apparent to the skilled artisan.

Any number of flavorants may be used in practicing the present invention such as menthol, vanillin, artificial coffee, tobacco extracts, nicotine, nicotine salts, caffeine, liquors, cocoa butter, and other agents which impart flavor to the aerosol produced by the smoking article. Other flavorants which may be employed includes those listed in Leffingwell et al., "Tobacco Flavorings for Smoking Products", R.J. Reynolds Tobacco Company, Winston-Salem, N.C. (1972).

The amount of flavorant impregnated or otherwise carried by the sheet material may vary over a broad range depending on the type of flavorant, the load of flavorant, the carbon content of the sheet material, the activity of the carbon, the location of the sheet material in the smoking article, the manner in which the carbon filled sheet material is rolled, folded, gathered or otherwise placed in the smoking article, and the like. For example, where a strong flavorant such as alpha ionone is used, it may be desirable to have amounts as low as 0.00001% by weight of the sheet material. When menthol is the flavorant, the amount may vary between 0.001% up to saturation. In preferred smoking articles, such as those described in Example I, the amount of menthol incorporated into the carbon filled sheet material is between about 3 to 6%, most preferably between about 4 to 5%.

As noted above, in certain preferred embodiments the carbon filled sheet material is located between the aerosol generating means and a mouthend filter and is preferably in the shape of a cylindrical filter plug. The sheet material may be formed into a cylindrical or other appropriate shape by conventional filter plug making techniques such as ordinary plugmakers used to make cellulose acetate tow.

Figure 3A:
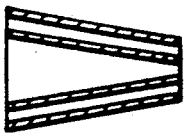
FIG. 3A illustrates a double cone system used to gather or fold material into the shape of a filter plug.
Figure 3:
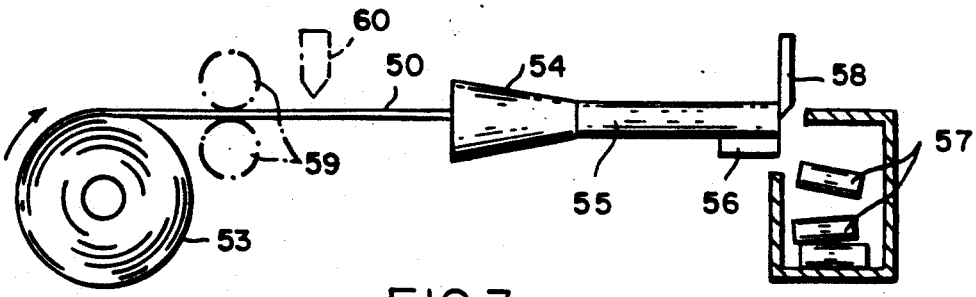
FIG. 3 schematically illustrates a method for forming the carbon filled sheet material into a cylindrical segment in the shape of a filter plug.

FIG. 3 illustrates one means for forming the carbon filled sheet material into the shape of a filter plug. As shown schematically in FIG. 3, a roll 53 of flavored carbon filled sheet material 50 is unwound and drawn into a pre-forming tapered cone 54 that "gathers" or "folds" the sheet material 50 into a cylindrical shape suitable for passage into the cylindrical plugmaker. Two or more carbon filled sheets of varying properties, e.g., having different carbon contents, flavorants, etc. can be processed separately or simultaneously to produce a multi-segmented or multilayered flavorant delivery means. This formed cylinder 55 receives a wrapping of paper 56 and the combination is cut into desired lengths 57 using blade 58. Prior to entering the garniture, a continuous bead of adhesive is applied to one edge of the overwrap paper 56 via an applicator. As these components pass through the garniture, the formed cylinder 55 is further compressed into a cylindrical cross-sectional rod while at the same time being enveloped by the paper 56. As the adhesive bead contacts the overlapped section of wrapped rod, it is sealed by means of a sealing bar. This endless cylindrical rod is then cut into lengths 57 by means of cutter 58.

Alternatively, it is preferred to use the double cone system illustrated in FIG. 3A in lieu of the single cone 54. This system comprises a cone within a cone as the preforming apparatus. The carbon filled sheet material is fed into the annular space between the cones in a substantially tension-free state, such that at the entry point, the sheet material wraps around the radial portion of the inner cone. The cones may be moved in relation to each other in order to achieve the desired uniformity and firmness of the cylindrical segment.

While not essential for making acceptable cylindrical segments of flavored carbon filled sheet material, the sheet material lends itself to addition of flavorants prior to being formed into a cylindrical segment. Two such treatments, illustrated in FIG. 3, may include a pair of grooved rolls 59 used for crimping and a liquid applicator 60 used for surface treating the sheet material with, for example, menthol, glycerin or other flavorants or humectants.

In preferred embodiments in which the carbon filled sheet material is interposed between the aerosol generating means and the mouth end filter in the form of a cylindrical segment or plug, the length of the flavored carbon filled sheet segment will, in general, vary with the type and amount of flavorant used. For cigarettes employing the preferred mouthend piece described in Example I, infra, the segment of carbon filled sheet material is generally between about 5 and 30 mm in length, preferably between about 5 and 15 mm in length, and most preferably about 10 mm in length.

From a performance and/or aesthetic standpoint the firmness of the flavored carbon filled sheet segment employed in accordance with the present invention may vary broadly without substantially interfering with delivery of aerosol to the user. However, it is desirable to have a segment which feels and has the firmness of a cigarette which employs conventional cellulose acetate filters.

The overall pressure drop of smoking articles employing the improved flavorant delivery means in accordance with the present invention is preferably similar to or less than that of other cigarettes. The pressure drop of the carbon filled sheet material and filter material in the mouthend piece itself will vary in accordance with the pressure drop of the front end piece of the smoking article. For preferred smoking articles, such as those described in Example I, infra, the pressure drop will generally be less than that of conventional filter plugs, normally in the range of about 0.1 to 6.0 cm water/cm filter length, preferably in the range of from about 0.5 to about 4.5 cm water/cm filter length, and most preferably in the range of from about 0.7 to about 1.5 cm water/cm filter length. Filter pressure drop is the pressure drop in centimeters of water when 1050 $cm^3$/min. of air is passed through a filter plug. These pressure drops may be normalized to unit length of filter plug by dividing by the actual filter length.

Preferred smoking articles which employ the improved flavorant delivery means in accordance with the present invention are described in the following patent applications:

| Applicants | Ser. No. | Filed |
|---|---|---|
| Sensabaugh et al. | 650,604 | September 14, 1984 |
| Shannon et al. | 684,537 | December 21, 1984 |
| Farrier et al. | 769,532 | August 26, 1985 |
| Banerjee et al. | 939,203 | December 8, 1986 |
| Sensabaugh et al. | EPO 85111467.8 | September 11, 1985 (published 3/19/86) |
| Banerjee et al. | EPO 86109589.1 | September 14, 1985 (published 3/4/87) |

the disclosures of which are hereby incorporated by reference.

Figure 1A:
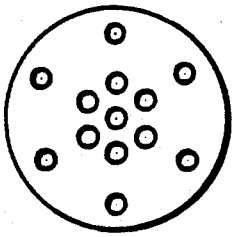
FIG. 1A illustrates, from the lighting end, a preferred fuel element passageway configuration.

One such preferred smoking article is illustrated in FIG. 1 accompanying this specification. Referring to FIG. 1, there is illustrated a cigarette having a small carbonaceous fuel element 10 with a plurality of passageways 11 therethrough, preferably about thirteen arranged as shown in FIG. 1A. Another preferred embodiment employs a fuel element having eleven holes similar to the arrangement in FIG. 1A, but with only five central passageways formed in an "X" pattern. This fuel element is formed from an extruded mixture of carbon (preferably from carbonized paper), sodium carboxymethyl cellulose (SCMC) binder, $K_2CO_3$, and water, as described in the above referenced patent applications and EPO applications.

The periphery 8 of fuel element 10 is encircled by a resilient jacket of insulating fibers 16, such as glass fibers.

A metallic capsule 12 overlaps a portion of the mouthend of the fuel element 10 and encloses the physically separate aerosol generating means which contains a substrate material 14 which carries one or more aerosol forming materials. The substrate may be in particulate form, in the form of a rod, or in other forms as detailed in the above referenced patent applications.

Capsule 12 is circumscribed by a roll of tobacco filler 18. Two slit-like passageways 20 are provided at the mouth end of the capsule in the center of the crimped tube.

At the mouth end of tobacco roll 18 is a mouthend piece 22, preferably comprising a cylindrical segment of a flavored carbon filled sheet material 24 of this invention and a segment of non-woven thermoplastic fibers 26 through which the aerosol passes to the user. The article, or portions thereof, is overwrapped with one or more layers of cigarette papers 30–36.

As noted above, the carbon filled sheet material may be located in one or more of the other non-burning components of the smoking article. For example, the carbon filled sheet material could be shredded and included as all or a portion of the tobacco roll, or it could be used as one or more of the non-burning wrappers used to combine the various components of the smoking article.

Upon lighting the aforesaid cigarette, the fuel element burns, generating the heat used to volatilize the tobacco flavor material and any additional aerosol forming substance or substances in the aerosol generating means and the tobacco roll. Because the preferred fuel element is relatively short, the hot, burning fire cone is always close to the aerosol generating means which maximizes heat transfer to the aerosol generating means and the tobacco roll, and resultant production of aerosol and tobacco flavors, especially when the preferred heat conducting member is used. The hot gases, aerosol and flavors from the aerosol generating means and tobacco roll, heat the flavored carbon filled sheet material of this invention which releases the flavorant therefrom.

Because of the small size and burning characteristics of the fuel element, the fuel element usually begins to burn over substantially all of its exposed length within a few puffs. Thus, that portion of the fuel element adjacent to the aerosol generator becomes hot quickly, which significantly increases heat transfer to the aerosol generator and tobacco roll, especially during the early and middle puffs. Because the preferred fuel element is so short, there is never a long section of nonburning fuel to act as a heat sink, as was common in previous thermal aerosol articles. This, in turn, increases the temperature to which the flavored carbon filled sheet material is exposed, which, it is believed, increases the release of the flavorant from the carbon component of the sheet. However, because the aerosol forming and tobacco flavor substances and the flavorant on the carbon filled sheet material are physically separate from the fuel element, they are exposed to substantially lower temperatures than are generated by the burning fuel, thereby minimizing the possibility of thermal degradation of flavorants and aerosol forming substances.

In preferred embodiments, the short carbonaceous fuel element, heat conducting member and insulating member cooperate with the aerosol generator and tobacco roll to provide a system which is capable of producing substantial quantities of aerosol, tobacco flavors and flavorant from the carbon filled sheet material on virtually every puff. The close proximity of the fire cone to the aerosol generator and tobacco roll after a few puffs, together with the insulating member, results in high heat delivery both during puffing and during the relatively long period of smolder between puffs.

In general, the combustible fuel elements which may be employed in preferred embodiments have a diameter no larger than that of a cigarette (i.e., less than or equal to 8 mm), and are generally less than about 30 mm long prior to smoking. Advantageously the fuel element is about 15 mm or less in length, preferably about 10 mm or less in length. Advantageously, the diameter of the fuel element is between about 2 to 8 mm, preferably about 4 to 6 mm. The density of the fuel elements employed herein may generally range from about 0.7 g/cc to about 1.5 g/cc. Preferably the density is greater than about 0.85 g/cc.

The preferred material used for the formation of fuel elements is carbon. Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% by weight may be used, especially where a minor amount of tobacco, tobacco extract, or a nonburning inert filler is used. Preferred fuel elements are described in greater detail in the above referenced patent applications and EPO publications.

The aerosol generating means used in practicing this invention is physically separate from the fuel element. By physically separate is meant that the substrate, container, or chamber which contains the aerosol forming materials is not mixed with, or a part of, the fuel element. This arrangement helps reduce or eliminate thermal degradation of the aerosol forming substance and the presence of sidestream smoke. While not a part of the fuel element, the aerosol generating means preferably abuts, is connected to, or is otherwise adjacent to the fuel element so that the fuel and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The aerosol generating means is preferably spaced no more than 15 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, and is preferably from about 3 to 6 mm.

Preferably, the aerosol generating means includes one or more thermally stable materials which carry one or more aerosol forming substances. As used herein, a "thermally stable" material is one capable of withstanding the high, albeit controlled, temperatures, e.g., from about 400° C. to about 600° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol forming substances, are within the scope of this invention, provided they are capable of releasing sufficient aerosol forming vapors.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., as well as SGL carbon, available from Calgon Carbon, Corp. Other suitable materials include inorganic solids, such as ceramics, glass, alumina, vermiculite, clays such as bentonite, or mixtures thereof. Carbon and alumina substrates are preferred.

An especially useful alumina substrate is a high surface area alumina (about 280 $m^2/g$), such as the W.R. Grace & Co. under the designation SMR-14-1896. This alumina (−14 to +20 U.S. mesh) is preferably sintered for about one hour at an elevated temperature, e.g., greater than 1000° C., preferably from about 1400° to 1550° C., followed by appropriate washing and drying, prior to use.

The aerosol forming substance or substances used in the articles of the present invention must be capable of forming an aerosol at the temperatures present in the aerosol generating means upon heating by the burning fuel element. Such substances preferably are non-tobacco, non-aqueous aerosol forming substances and are composed of carbon, hydrogen and oxygen, but they may include other materials. Such substances can be in solid, semi-solid, or liquid form. The boiling or sublimation point of the substance and/or the mixture of substances can range up to about 500° C. Substances having these characteristics include: polyhydric alcohols, such as glycerin, triethylene glycol, and propylene glycol, as well as aliphatic esters of mono-, di-, or polycarboxylic acids, such as methyl stearate, dimethyl dodecandioate, dimethyl tetradecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed by any known technique on or within the substrate in a concentration sufficient to permeate or coat the material. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 140 mg, and preferably from about 40 mg to about 110 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials such as those described in Leffingwell et al., suora. Alternatively, these optional agents may be placed in the mouthend piece, or in the preferred tobacco charge.

One particularly preferred aerosol generating means comprises the aforesaid alumina substrate containing spray dried tobacco extract, levulinic acid or glucose pentaacetate, one or more flavoring agents, and an aerosol former such as glycerin.

A charge of tobacco may be employed downstream from the fuel element. In such cases, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

The heat conducting material employed in preferred embodiments as the container for the aerosol generating means is typically a metallic foil, such as aluminum foil, varying in thickness from less than about 0.01 mm to about 0.1 mm, or more. The thickness and/or the type of conducting material may be varied (e.g., Grafoil, from Union Carbide) to achieve the desired degree of heat transfer.

As shown in the embodiment illustrated in FIG. 1, the heat conducting member preferably contacts or overlaps the rear portion of the fuel element, and may form the container or capsule which encloses the aerosol producing substrate of the present invention. Preferably, the heat conducting member extends over no more than about one-half the length of the fuel element. More preferably, the heat conducting member overlaps or otherwise contacts no more than about the rear 5 mm, preferably 2–4 mm, of the fuel element. Preferred recessed members of this type do not interfere with the lighting or burning characteristics of the fuel element. Such members help to extinguish the fuel element when it has been consumed to the point of contact with the conducting member by acting as a heat sink. These members also do not protrude from the lighting end of the article even after the fuel element has been consumed.

The insulating members employed in the preferred smoking articles are preferably formed into a resilient jacket from one or more layers of an insulating material. Advantageously, this jacket is at least about 0.5 mm thick, preferably at least about 1 mm thick. Preferably, the jacket extends over more than about half, if not all of the length of the fuel element. More preferably, it also extends over substantially the entire outer periphery of the fuel element and the capsule for the aerosol generating means. As shown in the embodiment of FIG. 1, different materials may be used to insulate these two components of the article.

The currently preferred insulating materials, particularly for the fuel element, are ceramic fibers, such as glass fibers. Preferred glass fiber include experimental materials produced by Owens - Corning of Toledo, Oh. under the designations C GLASS S-158, 6432 and 6437. Other suitable insulating materials, preferably non-combustible inorganic materials, may also be used.

To maximize aerosol delivery, which otherwise could be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include RJR Archer's 88-17234 paper, RJR Archer's 8-0560-36 Tipping with Lip Release paper, Ecusta's 646 Plug Wrap and ECUSTA 30637-801-12001 manufactured by Ecusta of Pisgah Forest, NC, and Kimberly-Clark Corporation's papers P1768-182, P780-63-5, P850-186-2, P1487-184-2 and P850-1487-125. Preferably, the filter is provide with a series of holes located about 23 mm from the mouthend of the smoking article to provide about 22% air dilution.

The aerosol produced by the preferred smoking articles of the present invention is chemically simple, consisting essentially of air, oxides of carbon, aerosol former including any desired flavors or other desired volatile materials, water and trace amounts of other materials. The WTPM produced by the preferred articles of this invention has no mutagenic activity as measured by the Ames Test, i.e., there is no significant dose response relationship between the WTPM produced by preferred smoking articles of the present invention and the number of revertants occurring in standard test microorganisms exposed to such products. According to the proponents of the Ames Test, a significant dose dependent response indicates the presence of mutagenic materials in the products tested See Ames et al., Mut. Res. 31: 347–364 (1975); Nagao et al., *Mut. Res.* 42: 335 (1977).

A further benefit from the preferred embodiments of the present invention is the relative lack of ash produced during use in comparison to ash from other cigarettes. As the preferred carbon fuel element is burned, it is essentially converted to oxides of carbon, with relatively little ash generation, and thus there is no need to dispose of ashes while using the smoking article of the present invention.

The use of the improved flavorant delivery means of the present invention in cigarettes will be further illustrated with reference to the following examples which will aid in the understanding of the present invention, but which are not to be construed as a limitation thereof. All percentages reported herein, unless otherwise specified, are percent by weight. All temperatures are expressed in degrees Celsius and are uncorrected.

EXAMPLE I

A cigarette of the type illustrated in FIG. 1 was made in the following manner.

A. Fuel Source Preparation

The fuel element (10 mm long, 4.5 mm o.d.) having an apparent (bulk) density of about 0.86 g/cc, was prepared from carbon (90 weight percent), SCMC binder (10 wt. percent) and $K_2CO_3$ (1 weight percent).

The carbon was prepared by carbonizing a non-talc containing grade of Grand Prairie Canadian Kraft hardwood paper under a nitrogen blanket, at a step-wise increasing temperature rate of about 10° C. per hour to a final carbonizing temperature of 750° C.

After cooling under nitrogen to less than about 35° C., the carbon was ground to a mesh size of minus 200 (U.S.). The powdered carbon was then heated to a temperature of up to about 850° C. to remove volatiles.

After again cooling under nitrogen to less than about 35° C., the carbon was ground to a fine powder, i.e., a powder having an average particle size of from about 0.1 to 50 microns.

This fine powder was admixed with Hercules 7HF SCMC binder (9 parts carbon : 1 part binder), 1 wt. percent $K_2CO_3$, and sufficient water to make a stiff, dough-like paste.

Fuel elements were extruded from this paste having seven central holes each about 0.021 in. in diameter and six peripheral holes each about 0.01 in. in diameter. The web thickness or spacing between the central holes was about 0.008 in. and the average outer web thickness (the spacing between the periphery and peripheral holes) was 0.019 in. as shown in FIGS. 1A.

These fuel elements were then baked-out under a nitrogen atmosphere at 900° C. for three hours after formation.

B. Spray Dried Extract

A blend of flue cured tobaccos were ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, an Anhydro Size No. 1, at an inlet temperature of from about 215°-230° C. and collecting the dried powder material at the outlet of the drier. The outlet temperature varied from about 82°-90° C.

C. Preparation of Sintered Alumina

High surface area alumina (surface area of about 280 $m^2/g$) from W.R. Grace & Co., having a mesh size of from −14 to +20 (U.S.) was sintered at a soak temperature of about 1400° C. to 1550° C. for about one hour, washed with water and dried. This sintered alumina was combined, in a two step process, with the ingredients shown in Table I in the indicated proportions:

TABLE I

| | |
|---|---|
| Alumina | 68.11% |
| Glycerin | 19.50% |
| Spray Dried Extract | 8.19% |
| HFCS (Invertose) | 3.60% |
| Abstract of Cocoa | 0.60% |
| Total: | 100.0% |

In the first step, the spray dried tobacco extract was mixed with sufficient water to form a slurry. This slurry was then applied to the alumina carrier described above by mixing until the slurry was uniformly absorbed by the alumina. The treated alumina was then dried to reduce the moisture content to about 1 weight percent. In the second step, this treated alumina was mixed with a combination of the other listed ingredients until the liquid was substantially absorbed within the alumina carrier.

D. Assembly

The capsule used to construct the FIG. 1 cigarette was prepared from deep drawn aluminum. The capsule had an average wall thickness of about 0.004 in. (0.1 mm), and was about 30 mm in length, having an outer diameter of about 4.5 mm. The rear of the container was sealed with the exception of two slot-like openings (each about 0.65×3.45 mm, spaced about 1.14 mm apart) to allow passage of the aerosol former to the user. About 330 mg of the aerosol producing substrate described above was used to load the capsule. A fuel element prepared as above, was inserted into the open end of the filled capsule to a depth of about 3 mm.

E. Insulatinq Jacket

The fuel element - capsule combination was overwrapped at the fuel element end with a 10 mm long, glass fiber jacket of Owens-Corning C GLASS S-158 with 3 weight percent pectin binder, to a diameter of about 7.5 mm. The glass fiber jacket was then wrapped with an innerwrap material, a Kimberly-Clark experimental paper designated P780-63-5.

F. Tobacco Roll

A 7.5 mm diameter tobacco rod (28 mm long) with an overwrap of Kimberly-Clark's P1487-125 paper was modified by insertion of a probe to have a longitudinal passageway of about 4.5 mm diameter therein.

G. Assembly

The jacketed fuel element - capsule combination was inserted into the tobacco rod passageway until the glass fiber jacket abutted the tobacco. The glass fiber and tobacco sections were joined together by an outerwrap material which circumscribed both the fuel element/insulating jacket/innerwrap combination and the wrapped tobacco rod. The outerwrap was a Kimberly-Clark paper designated P1768-182.

A mouthend piece of the type illustrated in FIG. 1, was constructed by combining two sections; (1) a 10 mm long, 7.5 mm diameter carbon filled tobacco sheet material adjacent the capsule, overwrapped with Kimberly Clark's P850-184-2 paper and (2) a 30 mm long, 7.5 mm diameter cylindrical segment of a non-woven melt-blown thermoplastic polypropylene web obtained from Kimberly-Clark Corporation, designated PP-100-F, overwrapped with Kimberly-Clark Corporation's P1487-184-2 paper.

The carbon filled tobacco sheet material was prepared by incorporating about 17% of PCB-G activated carbon from Calgon Carbon Corporation into a paper furnish used to make a sheet material obtained from Kimberly-Clark Corporation designated P144-185-GAPF. This material was loaded with about 4.5% by weight menthol flavorant by an inner leaf transfer method. Both sections of the mouthend piece were prepared by passing the tobacco paper and web of thermoplastic fibers through the double cone forming system described above. These two sections were combined with a combining overwrap of Kimberly-Clark Corporation's P850-186-2 paper.

The combined mouthend piece section was joined to the jacketed fuel element - capsule section by a final overwrap of Ecusta's 30637-801-12001 tipping paper.

Cigarettes thus prepared produced a mentholated aerosol without any undesirable off-taste due to scorching or thermal decomposition of the menthol or other aerosol forming material. Sensory evaluations comparing such articles with commercially available low tar mentholated cigarettes showed similar results for menthol taste perception and delivery.

EXAMPLE II

Cigarettes similar to those described in Example I were constructed in order to study the migration of menthol from its place of origin to the fuel source over a 10 day period under 75/40 humidity conditions (75° F. and 45% relative humidity). All prototypes were loaded with approximately the same amount of menthol. Prototypes A and B had menthol added directly to both the tobacco jacket and the aerosol carrying substrate. Prototypes C and D had menthol in the segment of Kimberly-Clark's P144-185-GAPF tobacco paper sheet (the sheet material prepared without any carbon content) located between the aerosol generating means and the filter. Prototype E had the menthol loaded onto plastic like beads obtained from Narrden Flavor House, Germany under designation NFM. The beads were placed in a cavity made in the filter piece of the article. Prototype F had the menthol loaded onto an experimental sponge material obtained from Advanced Polymer Systems under designation CH-43-16 and incorporated into the P144-185-GAPF tobacco paper sheet (the sheet material prepared without any carbon content) placed between the aerosol generating means and filter portion of the article. Prototype G, prepared in accordance with the present invention, had menthol loaded onto a 10 mm segment of the carbon filled tobacco sheet material of the present invention located between the aerosol generating means and the filter.

Figure 2:
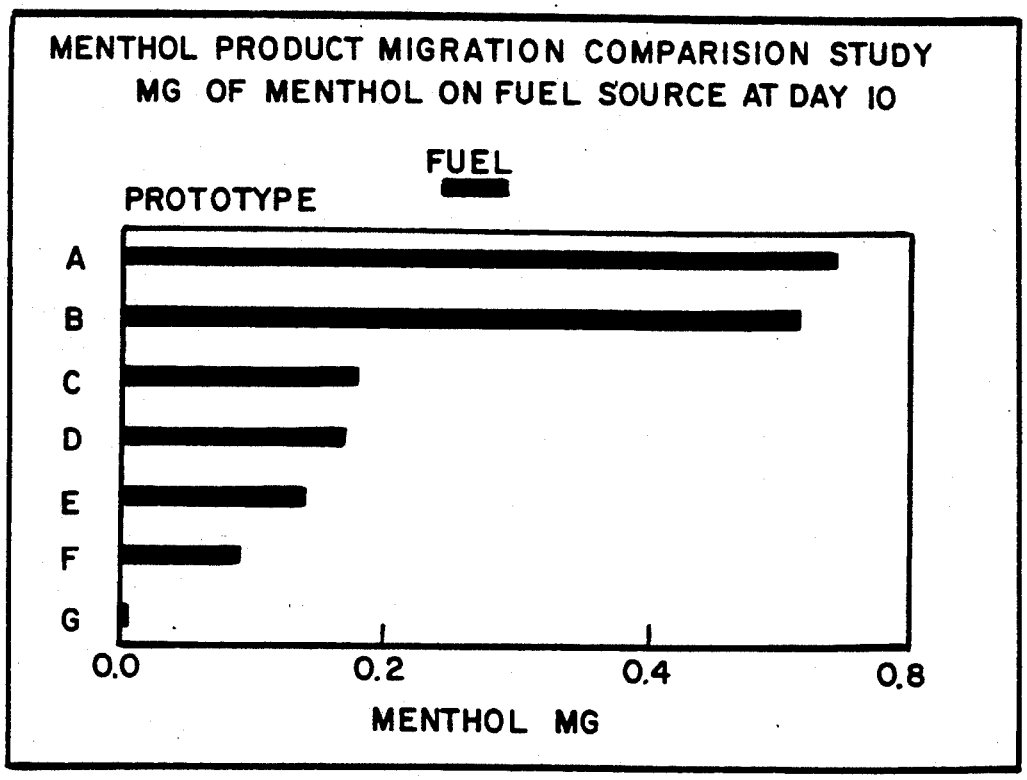
FIG. 2 illustrates the results of a migration study of preferred cigarettes with and without the carbon filled sheet material of the present invention.

As can be seen from FIG. 2, there is a substantial reduction in the migration of menthol to the fuel. source of such articles when the menthol is loaded onto the carbon filled sheet material of the present invention and used in lieu of the normal tobacco paper plug.

What is claimed:

1. A smoking article comprising:
(a) a fuel element;
(b) a physically separate aerosol generating means including at least one aerosol forming material; and
(c) separate means for delivering the aerosol produced by the aerosol generating means to the smoker, the delivery means including a carbon filled sheet material bearing at least one flavorant and being longitudinally disposed behind the aerosol generating means.

2. The smoking article of claim 1, wherein the aerosol delivery means comprises a mouthend piece including a filter plug and a segment of the carbon filled sheet material located between the aerosol generating means and the filter plug.

3. The smoking article of claim 2, wherein the carbon filled sheet material is in the form of a cylinder.

4. The smoking article of claim 2, wherein the carbon filled sheet material is shredded.

5. The smoking article of claim 1, 2, 3, or 4, wherein the carbon content of the sheet material by weight percent is between about 5 and 75%.

6. The smoking article of claim 5, wherein the carbon content of the sheet material by weight percent is between about 10 and 40%.

7. The smoking article of claim 5, wherein the carbon content of the sheet material by weight percent is between about 15 and 30%.

8. The smoking article of claim 3, wherein the flavorant is menthol in an amount by weight percent from about 0.001 up to saturation.

9. The smoking article of claim 8, wherein the amount of menthol by weight percent is between about 3 and 6%.

10. The smoking article of claim 8, wherein the amount of menthol by weight percent is between about 4 and 5%.

11. The smoking article of claim 1, 2, 3, 4, 8, 9, or 10, wherein the carbon filled sheet material is a tobacco containing paper.

12. The smoking article of claim 11, wherein the tobacco content of the sheet material by weight percent is about 65%.

13. The smoking article of claim 3, wherein the cylinder of carbon filled sheet material is between about 5 mm and 30 mm in length.

14. The smoking article of claim 13, wherein the cylinder of carbon filled sheet material is between about 5 mm and 15 mm in length.

15. The smoking article of claim 1, 2, 3, 4, or 6, wherein the fuel element is less than about 30 mm long prior to smoking.

16. The smoking article of claim 1, wherein the fuel element and the aerosol generating means are in a conductive heat exchange relationship.

17. The smoking article of claim 16, wherein the conductive heat exchange relationship is provided by a heat conductive member which contacts both the fuel element and the aerosol generating means.

18. The smoking article of claim 17, wherein the heat conductive member circumscribes at least a portion of the fuel element.

19. The smoking article of claim 17, wherein the heat conductive member encloses at least a portion of the aerosol forming material.

20. The smoking article of claim 1, wherein the fuel element comprises carbon.

21. The smoking article of claim 20, wherein the fuel element is less than 30 mm long prior to smoking and has a density of at least about 0.85 g/cc.

22. The smoking article of claim 1, further comprising an insulating member which encircles at least a portion of the fuel element.

23. The smoking article of claim 22, wherein the insulating member is a resilient, non-burning member at least 0.5 mm thick.

24. The smoking article of claim 1, further comprising a resilient insulating member encircling at least a portion of the aerosol generating means.

25. The smoking article of claim 24, wherein the insulating member comprises a tobacco containing material.

26. A smoking article comprising:
(a) a carbonaceous fuel element less than about 30 mm long prior to smoking:
(b) a physically separate aerosol generating means including at least one aerosol forming material; and
(c) separate means for delivering the aerosol produced by the aerosol generating means to the smoker, the delivery means including a carbon filled sheet material bearing at least one flavorant and being longitudinally disposed behind the aerosol generating means.

27. The smoking article of claim 26, wherein the aerosol delivery means comprises a mouthend piece including a 10 to 40 mm long filter plug and a 5 to 30 mm long segment of a carbon filled tobacco containing sheet material located between the aerosol generating means and the filter plug.

28. A smoking article comprising:
(a) a fuel element;
(b) a physically separate aerosol generating means longitudinally disposed behind the fuel element including at least one aerosol forming material and
(c) a carbon filled sheet material bearing at lease one flavorant, wherein the carbon filled sheet material is longitudinally disposed behind and is in a spaced apart relationship from the fuel element.

29. A smoking article comprising:
(a) a fuel element;
(b) a physically separate aerosol generating means longitudinally disposed behind the fuel element including at least one aerosol forming material; and
(c) a tobacco containing mass physically separate from the fuel element which includes a carbon filled sheet material bearing at least one flavorant.

30. The smoking article of claim 28, wherein the carbon filled sheet material is a wrapper for one or more components of the smoking article other than the fuel element.

31. The smoking article of claim 29, wherein at least a portion of the aerosol generating means is circumscribed by a tobacco containing mass which includes the carbon filled sheet material.

32. The smoking article of claim 26, 28, or 29, wherein the carbon content of the sheet material by weight percent is between about 5 and 75%.

33. The smoking article of claim 32, wherein the carbon content of the sheet material by weight percent is between about 10 and 40%.

34. The smoking article of claim 32, wherein the carbon content of the sheet material by weight percent is between about 15 and 30%.

35. The smoking article of claim 26, 28, or 29, wherein the flavorant is menthol in an amount by weight percent from about 0.001 up to saturation.

36. The smoking article of claim 35, wherein the amount of menthol by weight percent is between about 3 and 6%.

37. The smoking article of claim 35, wherein the amount of menthol by weight percent is between about 4 and 5%.

38. The smoking article of claim 26, 28, or 29, wherein the carbon filled sheet material is a tobacco containing paper.

39. The smoking article of claim 38, wherein the tobacco content of the sheet material by weight percent is about 65%.

40. The smoking article of claim 26, 28, or 29, wherein the fuel element and the aerosol generating means are in a conductive heat exchange relationship.

41. The smoking article of claim 40, wherein the conductive heat exchange relationship is provided by a heat conductive member which contacts both the fuel element and the aerosol generating means.

* * * * *